US011040265B2

(12) United States Patent
Rocas Alonso et al.

(10) Patent No.: US 11,040,265 B2
(45) Date of Patent: Jun. 22, 2021

(54) MACHINE FOR LAUNCHING BALLS

(71) Applicant: 2PI PROJECTES 2015, S.L., Gava (ES)

(72) Inventors: Marc Rocas Alonso, Gava (ES); Gerard Brinquis Navarro, Gava (ES); Dario Cesena Forcada, Gava (ES)

(73) Assignee: 2PI PROJECTES 2015, S.L., Gava (ES)

( * ) Notice: Subject to any disclaimer, the term of this patent is extended or adjusted under 35 U.S.C. 154(b) by 0 days.

(21) Appl. No.: 16/188,456

(22) Filed: Nov. 13, 2018

(65) Prior Publication Data

US 2020/0197781 A1 Jun. 25, 2020

Related U.S. Application Data

(63) Continuation-in-part of application No. PCT/ES2017/070292, filed on May 9, 2017.

(30) Foreign Application Priority Data

May 13, 2016 (ES) ..... ES201630618U

(51) Int. Cl.
*A63B 69/40* (2006.01)
*F41B 4/00* (2006.01)

(52) U.S. Cl.
CPC ..... *A63B 69/406* (2013.01); *A63B 2069/402* (2013.01)

(58) Field of Classification Search
CPC . A63B 69/40; A63B 69/406; A63B 2069/402; F41B 4/00

(Continued)

(56) References Cited

U.S. PATENT DOCUMENTS 3,308,802 A * 3/1967 Applegate ..... A63B 69/406 124/78
3,724,437 A * 4/1973 Halstead ..... A63B 69/406 124/78

(Continued)

FOREIGN PATENT DOCUMENTS

AR 027500 A1 4/2003
ES 2072735 T3 7/1995

(Continued)

OTHER PUBLICATIONS

International Search Report dated Jun. 28, 2017 for International Application No. PCT/ES2017/070292 filed May 9, 2017.

*Primary Examiner* — Alexander R Niconovich
(74) *Attorney, Agent, or Firm* — Blue Filament Law PLLC

(57) ABSTRACT

A frame is provided with at least two holes to fasten electrical and/or electronic devices. The frame includes a single body having fastening means to be fastened on at least one flush-mounted box, and that includes a first part incorporating a hole intended to be fastened on a flush-mounted box by fastening means adapted to fasten the frame on the flush-mounted box and a second part incorporating a hole that is not associated to a flush-mounted box. The frame, at least on the part incorporating the hole that is not associated to a box shows at least a separator element supporting the frame on the wall on which it is to be installed. The separator element is constituted by the frame itself folded creating a flap or rim, the separator element spanning on the whole or part of the perimeter of the frame.

17 Claims, 2 Drawing Sheets

(58) Field of Classification Search
USPC ..... 124/78; 473/422
See application file for complete search history.

(56) References Cited

U.S. PATENT DOCUMENTS

| | | | | | |
|---|---|---|---|---|---|
| 3,777,732 | A * | 12/1973 | Holloway | A63B 69/406 | 124/78 |
| RE28,462 | E * | 7/1975 | Halstead | A63B 69/406 | 124/78 |
| 4,086,903 | A * | 5/1978 | Scott | A63B 69/406 | 124/78 |
| 4,254,755 | A * | 3/1981 | Morgan | A63B 69/408 | 124/16 |
| 4,352,348 | A * | 10/1982 | Griffith | A63B 69/406 | 124/34 |
| 4,442,823 | A * | 4/1984 | Floyd | A63B 69/406 | 124/41.1 |
| 4,678,189 | A * | 7/1987 | Koss | A63B 47/02 | 473/436 |
| 4,922,885 | A * | 5/1990 | Iwabuchi | A63B 69/406 | 124/78 |
| 5,046,476 | A * | 9/1991 | Nozato | A63B 69/406 | 124/78 |
| 5,125,653 | A * | 6/1992 | Kovacs | A63B 69/406 | 124/78 |
| 5,359,986 | A * | 11/1994 | Magrath, III | A63B 69/406 | 124/1 |
| 5,415,150 | A * | 5/1995 | Dallas | A63B 69/407 | 124/16 |
| 5,464,208 | A * | 11/1995 | Pierce | A63B 69/406 | 124/78 |
| 5,776,018 | A * | 7/1998 | Simpson | A63B 24/0021 | 473/433 |
| 5,979,426 | A * | 11/1999 | Troklus | A63B 69/406 | 124/78 |
| 6,026,798 | A * | 2/2000 | Sanders | A63B 24/0003 | 124/78 |
| 6,082,350 | A * | 7/2000 | Crews | A63B 69/406 | 124/78 |
| 6,182,649 | B1 * | 2/2001 | Battersby | A63B 69/406 | 124/78 |
| 6,237,583 | B1 * | 5/2001 | Ripley | A63B 47/002 | 124/78 |
| 6,440,013 | B1 * | 8/2002 | Brown | A63B 69/406 | 124/6 |
| 6,470,873 | B2 * | 10/2002 | Battersby | A63B 69/406 | 124/78 |
| 6,488,020 | B1 * | 12/2002 | Rosas-Magallan | A63B 69/406 | 124/78 |
| 6,880,542 | B1 * | 4/2005 | Johndreau | A63B 69/406 | 124/78 |
| 7,082,938 | B2 * | 8/2006 | Wilmot | A63B 69/406 | 124/78 |
| 7,111,620 | B2 * | 9/2006 | Johndreau | A63B 69/406 | 124/51.1 |
| 7,445,003 | B2 * | 11/2008 | Smith | A63B 69/406 | 124/78 |
| 7,691,012 | B2 * | 4/2010 | Cucjen | A63B 69/406 | 473/422 |
| 8,893,698 | B2 * | 11/2014 | Boehner | A63B 69/406 | 124/78 |
| 9,022,016 | B1 * | 5/2015 | Hafer | F41B 4/00 | 124/78 |
| 9,050,520 | B2 * | 6/2015 | Lu | F41B 4/00 | |
| 9,789,379 | B1 * | 10/2017 | Bynum | A63B 69/40 | |
| 10,471,330 | B1 * | 11/2019 | Hart | A63B 69/0002 | |
| 2002/0148455 | A1 * | 10/2002 | Trajkovic | A63B 24/0021 | 124/34 |
| 2006/0236993 | A1 * | 10/2006 | Cucjen | A63B 69/406 | 124/78 |
| 2008/0032828 | A1 * | 2/2008 | Alger | A63B 69/406 | 473/446 |
| 2013/0104869 | A1 * | 5/2013 | Lewis | A63B 24/0075 | 124/78 |
| 2018/0280779 | A1 * | 10/2018 | Paulson | A63B 69/406 | |
| 2020/0038733 | A1 * | 2/2020 | Copland | G05B 19/042 | |

FOREIGN PATENT DOCUMENTS

| | | | |
|---|---|---|---|
| IT | 1400926 | B1 | 7/2013 |
| KR | 2020150003648 | U | 10/2015 |
| WO | 2004011870 | A1 | 2/2004 |

* cited by examiner

MACHINE FOR LAUNCHING BALLS

OBJECT OF THE INVENTION

The invention, as stated in the title of this specification refers to a ball throwing machine that contributes to the function to which it is designed, advantages and characteristics of novelty that will be described in detail thereafter, that mean a significant improvement compared with the already known in the market in its field of application.

This invention consists of an electrical motor-driven ball throwing machine, for example football balls, with the object, mainly, to serve as training, which, being of the type comprising a frame with two motor-powered rollers that rotate to throw the balls shot in one or the other direction, depending on the position they adopt in each throw, possesses an improved structural configuration in different aspects that makes it much more versatile and effective than the currently known similar machines, because, among other characteristics, it possesses means to easily set, through pushbuttons, the balls shooting position, allowing to incorporate up to five balls in the extensible handle it has and in addition it is possible to trigger the shot by means of a remote control.

FIELD OF APPLICATION OF THE INVENTION

The field of application of this invention is within the sector of the industry engaged in the production of sport apparatuses, systems and devices, namely for automatically throwing balls.

BACKGROUND OF THE INVENTION

With reference to the current state-of-art, it shall be pointed out that different documents are known that disclose machines and apparatuses of the type herein involved.

Concretely, by the patent ES2072735 a training electromagnetic apparatus is known for throwing balls, namely football balls, which essentially comprises a tank in which the balls are driven by gravity to a shot point where a motor-driven throwing arm has been provided.

For its part, patent AR027500A1 discloses a ball throwing machine preferably designed to athletes training, that comprises a balls throwing platform including at least a pair of driving belts facing each other and between which a gap to pick the balls to be thrown is defined, a propelling and throwing longitudinal trajectory being defined between the said belts, the platform having a first end with a ball receiving portion and a second end, opposite to the former of balls exit.

Also, U.S. Pat. No. 4,352,348 discloses a machine of the same type, concretely a machine for the practice of football including a pair of rotary wheels, juxtaposed opposite to each other, to propel a football ball towards a player. The orientation of these wheels can be selectively varied to allow that the football ball can be propelled in an infinite number of directions. In addition, the distance separating the juxtaposed rotation of the wheels can also be adjusted to accommodate football balls having variable diameters and it can be automatically increased to avoid damages to the large-sized balls due to the coupling by the wheels. In addition, this machine includes a large hopper having a rotatory endless screw that successively feed football balls in a flexible feeding tube and a downwards ramp where the wheels are incorporated to be outwardly propelled. The flexibility of the feeding tube and the rigidity of the ramp provide the accurate delivery of the balls to the wheels.

Also, and as the nearest document, patent IT1400926 discloses a machine for throwing different balls comprising a base frame, a ball throwing moving frame following a shooting direction and linking means adapted to vary the position of the said moving frame with respect to the base frame to vary the direction of the shot, characterized in that the said linking means comprise a spherical joint that allows to the said throwing moving frame three degrees of freedom of movement with respect to the base frame, a first or second degree of freedom that allows that the said throwing moving frame is oriented in the space to change the direction of the shot and a third degree of freedom that allows that the throwing moving frame can rotate about the said direction of shot.

Thus, even though the ball throwing machine proposed by this invention possesses some characteristics that are common to some of the mentioned documents that are already of the public domain, in no one of the preceding inventions and patents, separately or matched, it is seen that they disclose technical or structural characteristics equal or similar to those presented as new, as claimed.

EXPLANATION OF THE INVENTION

The ball throwing machine of this invention is therefore configured as a novelty within its field of application, the characterizing details that distinguish it from the already known duly appearing in the final claims attached to this description.

Concretely, what the invention proposes, as it was above mentioned, is an electric motor-powered machine that throws balls for training, for example football balls, that is configured in an already known manner, out of a frame with two rollers that rotate in opposite directions so that, when a ball enters between them, they throw it out, having, in a novelty manner, a series of improvements that make it more versatile, the said improvements comprising essentially to include means to set, by means of pushbuttons, the position of the rollers to orientate the direction of the shot of the balls, and, optionally, including an extensible handle that allows to incorporate, preferably, up to five balls to feed the throwing rollers and including means to remotely trigger the shot.

More particularly, the rollers are incorporated in the frame so that their position can be varied and, consequently, the orientation of the ball shot in one direction or the other, concretely, by means of a hinged joint. The means to set the shooting position, that means of the rollers, consist, preferably, in hydraulic springs that, by one end are coupled to the said hinged joint and by the other to a handle that is raising by the opposite part of the rollers and that serves to maneuvering the machine that has been endowed with wheels to facilitate its carriage, the said springs can be operated through pushbuttons provided at the upper end of the said handle, allowing in a practical, quick and easy manner, to vary the mentioned shooting position as often as wished to provide a varied training with throws in different directions.

In addition, in order that the shooting field of the rollers is as wide as possible, the hinged joint comprises three matched standard joints so that they provide a triaxial movement, that means, in the three axis of the space: of rotation to both sides on the horizontal plane, and of swinging upwards and downwards, and tilting towards one side and the other on the vertical plane, allowing the full control of the machine in the three axis.

As it was said, another of the characteristics of the machine, optional in this case, is that it allows to incorporate, preferably, up to five balls to feed the shooting rollers, for this, the said handle of the machine is telescopically extensible and is formed by two parallel bars that, ending in respective handgrips, determine a guide channel to hold, between those guide channels, several balls that, by gravity, are going down towards the rollers located at their lower end.

With this, in addition, the above described hydraulic springs that allow to set the throwing position, are joined by their upper end to the middle area of each of the said parallel bars and the pushbuttons locking them being incorporated to set the position in the respective handgrips.

As it was said above, another of the optional characteristics of the machine, is that shooting the balls can be remotely operated for which, preferably, the mechanism controlling the access of the balls to the throwing rollers, the rotation of which allows to reach shooting speeds ranging from 10 to 145 Km/h thanks to the fact that respective direct current motors powered by batteries of 12V Gel type provide it, is linked to an electronic micro actuator so that it can work, or by hand, through a mechanical actuator provided to that effect in the handle of the frame, or by means of a remote control device that acts on the radiofrequency module provided to that effect in the said actuator.

Last, it shall be pointed out that, preferably also, the machine incorporates a recording system, to display the training, by incorporating a video camera, preferably of GoPro® type.

The disclosed ball throwing machine therefore consists in an innovating structure having characteristics unknown until now for the purpose to which it is designed, reasons that jointly to its practical utility, provide it with sufficient ground to obtain the privilege of exclusivity applied for.

DESCRIPTION OF THE DRAWINGS

To complement the description being carried out and in order to assist to a best understanding of the characteristics of the invention, attached to this specification, as an integral part thereof, there is a set of drawings in which for illustrating and not limiting purpose the following has been represented:

The FIG. 1 It shows a front view in perspective of an example of embodiment of the ball throwing machine, object of the invention, the main parts and elements it comprises can be seen, as well as its configuration and disposition; and The FIG. 2 It shows a rear view in perspective of an example of embodiment of the machine, allowing to see the rest of the parts and elements it comprises.

PREFERRED EMBODIMENT OF THE INVENTION

At the sight of the said figures, and according to the numbering adopted in them, a non-limiting example of the ball throwing machine of the invention can be seen which comprises the parts and elements that are stated and disclosed below.

Figure 1:
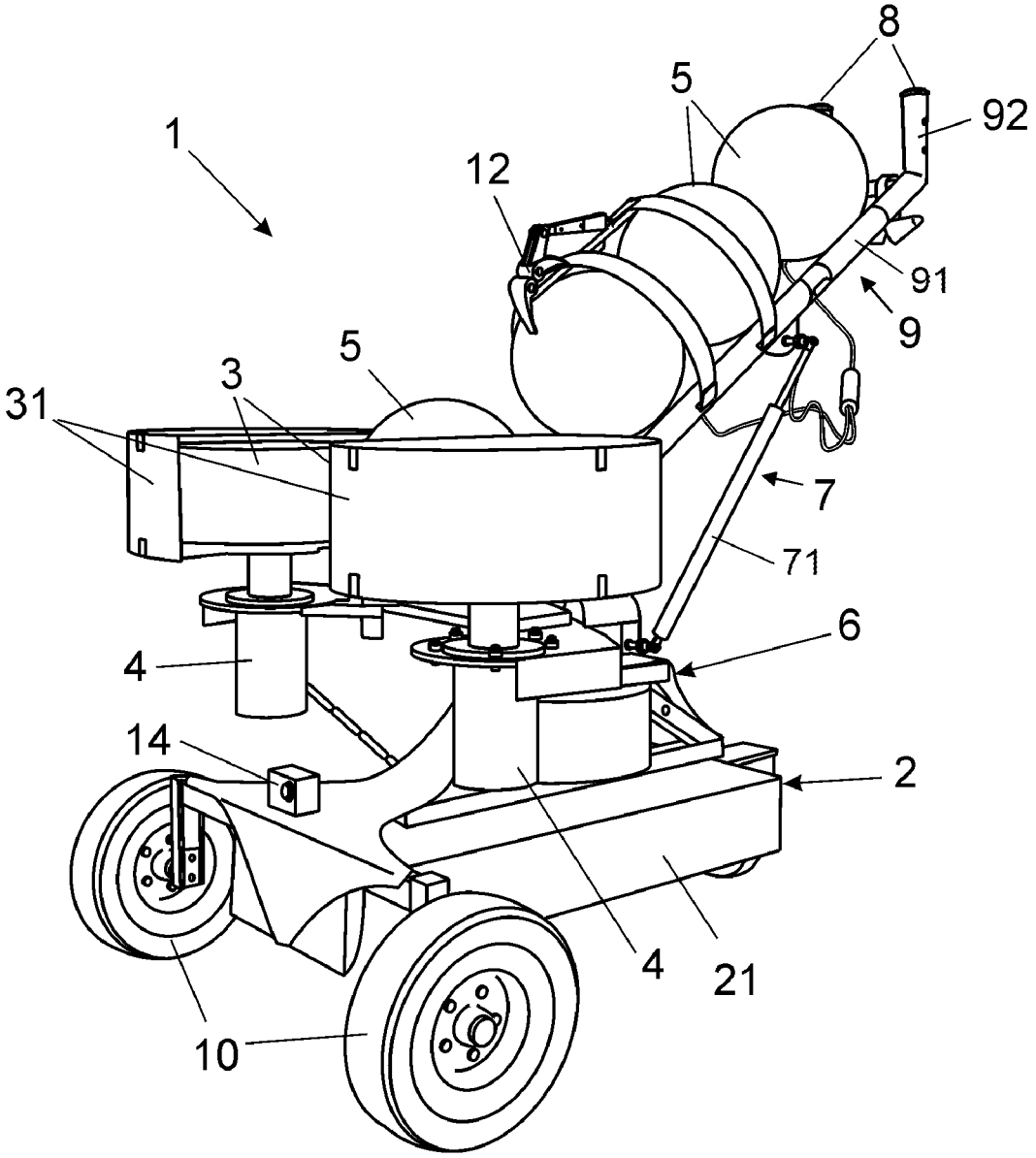
Figure 2:
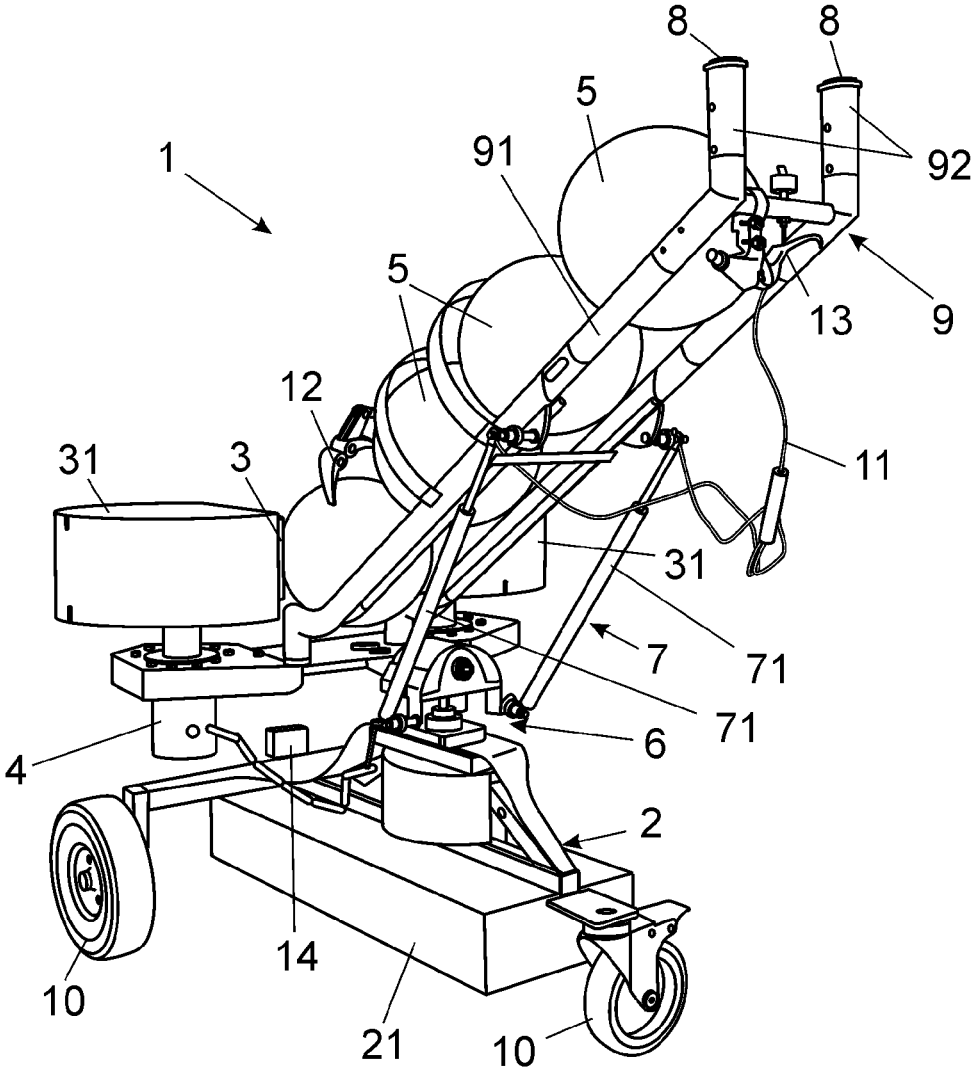

Thus, as it can be seen in the FIG. 1, the machine (1) involved is configured, in a known manner, from a frame (2) with two rollers (3) that, operated by means of electric motors (4), rotate in opposite directions to shoot a ball (5) that is located between them, the said rollers (3) being linked to the frame (2) through a hinged joint (6) that allows to move them to vary their position with respect to the frame (2) and, so, the trajectory of the shoot.

From that already known configuration, the machine (1) is distinguished in that it comprises, essentially, means (7) to vary the position of the rollers (3) with respect to the structure (2), that can be locked by means of pushbuttons (8) to set the said position, which, preferably, consist in respective hydraulic springs (71) that, by one lower end are coupled to the hinged joint (6) and by a upper end, the opposite, they are coupled to a handle (9) that raises by the rear part of the machine (1), the opposite to which the shot is made by means of the rollers (3), and serving to manoeuvre it, the pushbuttons (8) that operate and lock, depending on whether pressing or not the said springs (71), being incorporated in the upper end of the said handle (9).

Preferably, the hinged joint (6) comprises three standard type joints matched so that they provide a triaxial movement, that means, a rotation joint towards both sides, a swinging joint upwards and downwards and a tilting joint towards one side and the other.

Also, in a preferred manner, the rollers (3) are protected within related shells (31), the machine (1) incorporating in addition suitable wheels (10) to facilitate its carriage and arranged, preferably, two in the front part of the base (21) of the frame (2), and a rotatory one in the rear part of the said base.

Anyway, according to another optional characteristic of the machine, the handle (9) is telescopically extensible allowing to incorporate up to, for example, five balls (5) to feed the throwing rollers (3).

Advantageously, the said handle (9) is formed by two extensible and parallel bars (91) that, ending in respective handgrips (92), determine a guide channel to hold the said balls (5) that, by gravity, are going down the rollers (3) located in their lower end.

The hydraulic springs (71) for setting the throwing position, are joined by their upper end to the middle area of the said bars (91) while the pushbuttons (8) that are connected by means of a related wiring (11) remain incorporated in the handgrips (92).

Also preferably, the machine (1) of the invention possesses a retaining mechanism (12) that controls the access of the ball (5) located downstream the handle (9) to the rollers (3) for it launching, the said mechanism (12) being linked to an electronic micro actuator, so that it can work, or by hand through a mechanical actuator (13) provided to that effect in the handle (9), or by means of a remote control device (not represented) that acts on a radiofrequency module provided to that effect in the said actuator.

Last, optionally, in the base (21) of the frame (2) the incorporation of a camera (14) has been provided, located at the front part of the machine, to record the user who receives the balls thrown by this machine.

The nature of this invention being sufficiently described, as well as the way of implementing it, it is not deemed necessary to further extend its explanation in order that any man of the art understands its extent and the advantages arising from it and it is pointed out that, within its essence, it can be implemented in other embodiments that differ in details from the one stated for example purpose and to which the protection sought shall extend provided that its fundamental principle is not altered, changed of modified.

The invention claimed is:

1. A ball throwing machine, comprising a frame (2) having a handle (9);

two rollers (3) linked to the frame (2) that, powered by means of electric motors (4), rotate in opposite directions to shoot a ball (5) located between them along a trajectory of a shot, the two rollers (3) being linked to the frame (2) through a hinged joint (6) to vary a position of the two rollers (3) with respect to the frame (2) and with it the trajectory of the shot;

mechanical pushbuttons to vary the position of the two rollers (3) with respect to the frame (2), that can be locked by means of said mechanical pushbuttons (8) to set the position, the mechanical pushbuttons located on the handle (9) to set a shooting position of the ball (5), wherein the mechanical pushbuttons are engaged to allow free movement to adjust the position of the rollers and are disengaged to prevent movement and lock the position of the rollers with respect to the frame.

2. The ball throwing machine, according to claim 1, further comprising hydraulic springs (71) to vary the position of the two rollers (3), that can be locked by means of said mechanical pushbuttons (8).

3. The ball throwing machine, according to claim 2, characterized in that it possesses two hydraulic springs (71) that, by a lower end, are coupled to the hinged joint (6) and by an upper end, opposite to the lower end, they are coupled to the handle (9) that raises at a rear part of the machine (1), and that serves to maneuver the machine (1).

4. The ball throwing machine, according to claim 3, characterized in that the handle (9) is telescopically extensible allowing to incorporate multiple balls (5) to feed the two rollers (3).

5. The ball throwing machine, according to claim 4, characterized in that each handle (9) is constituted by extensible and parallel bars (91) that, ending in respective handgrips (92), determine a guide channel to hold the multiple balls (5).

6. The ball throwing machine, according to claim 3, characterized in that each handle (9) is constituted by extensible and parallel bars (91) that, ending in respective handgrips (92), determine a guide channel to hold the ball (5).

7. The ball throwing machine, according to claim 3, characterized in that the said mechanical pushbuttons (8) of the hydraulic springs (71) are incorporated at an upper end of the handle (9).

8. The ball throwing machine, according to claim 3, characterized in that the hinged joint (6) comprises three standard type joints matched so that they provide a triaxial movement.

9. The ball throwing machine, according to claim 3, characterized in that the ball (5) includes up to 5 balls.

10. The ball throwing machine, according to claim 2, characterized in that the pushbuttons (8) of the hydraulic springs (71) are incorporated at an upper end of the handle (9).

11. The ball throwing machine, according to claim 10, characterized in that the handle (9) is telescopically extensible allowing to incorporate the balls (5) to feed the two rollers (3).

12. The ball throwing machine, according to claim 10, characterized in that each handle (9) is constituted by extensible and parallel bars (91) that, ending in respective handgrips (92), determine a guide channel to hold the ball (5).

13. The ball throwing machine, according to claim 2, characterized in that the hinged joint (6) comprises three standard type joints matched so that they provide a triaxial movement.

14. The ball throwing machine, according to claim 1, characterized in that the hinged joint (6) comprises three standard type joints matched so that they provide a triaxial movement.

15. The ball throwing machine, according to claim 1, characterized in that it possesses a retaining mechanism (12) that controls access of the ball (5) to the two rollers (3) for its throwing, the retaining mechanism (12) works, by hand, through a mechanical actuator (13), and by remote control linked to an electronic micro actuator.

16. The ball throwing machine, according to claim 1, characterized in that it incorporates a camera (14) located at a front part of the machine to record a user who receives the ball (5) thrown.

17. The ball throwing machine, according to claim 1, characterized in that the mechanical pushbuttons are mechanically coupled to hydraulic springs (71) that, by one lower end are coupled to the hinged joint (6) and by an upper end coupled to the handle (9) that raises a rear part of the machine (1).

* * * * *